US011806884B2

(12) United States Patent
Eijkelkamp et al.

(10) Patent No.: US 11,806,884 B2
(45) Date of Patent: Nov. 7, 2023

(54) PRESSURE SENSING ELECTRIC SHAVER

(71) Applicant: KONINKLIJKE PHILIPS N.V., Eindhoven (NL)

(72) Inventors: Marcus Franciscus Eijkelkamp, Peize (NL); Daniele Solerio, Groningen (NL); Joost Willem Frederik Nengerman, Groningen (NL); Martijn Van Zutphen, Marum (NL); Joop Hendriks, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/687,766

(22) Filed: Mar. 7, 2022

(65) Prior Publication Data

US 2022/0184830 A1 Jun. 16, 2022

Related U.S. Application Data

(63) Continuation of application No. 17/284,897, filed as application No. PCT/EP2020/060302 on Apr. 10, 2020, now abandoned.

(30) Foreign Application Priority Data

Apr. 18, 2019 (EP) ..... 19170323

(51) Int. Cl.
*B26B 19/38* (2006.01)
*B26B 19/14* (2006.01)

(52) U.S. Cl.
CPC ..... *B26B 19/388* (2013.01); *B26B 19/14* (2013.01); *B26B 19/386* (2013.01); *B26B 19/3813* (2013.01)

(58) Field of Classification Search
CPC ... B26B 19/14; B26B 19/382; B26B 19/3853; B26B 19/388; B26B 21/4056;
(Continued)

(56) References Cited

U.S. PATENT DOCUMENTS 5,632,087 A * 5/1997 Motohashi ..... H02P 25/032 30/43.92
5,983,502 A * 11/1999 Geertsma ..... B26B 19/14 30/43.6

(Continued)

FOREIGN PATENT DOCUMENTS

EP 0674979 10/1995
JP 2010227223 10/2010

(Continued)

OTHER PUBLICATIONS

International Search Report and Written Opinion dated Aug. 3, 2020 For International Application No. PCT/EP2020/060302 Filed Apr. 10, 2020.

(Continued)

*Primary Examiner* — Jonathan G Riley

(57) ABSTRACT

An electric shaver having a shaving unit and a sensor with a first sensor unit fixed to a main body and a second sensor unit fixed to a sensor unit carrier, for indicating a distance between the sensor units. The shaving unit and the sensor unit carrier are suspended to the main body for displacement along a z-axis between a rest position and a pushed-in position in response to a pushing force exerted onto a shaving face of the shaver. The first and second sensor units are located in positions offset from the z-axis over a distance (d) in an x-direction. An anti-tilting guide is provided for guiding the sensor unit carrier against tilting about a y-axis.

20 Claims, 4 Drawing Sheets

(58) Field of Classification Search
CPC ..... B26B 19/3866; B26B 19/12; B26B 19/28; B26B 19/02; B26B 19/3813; B26B 19/386
See application file for complete search history.

(56) References Cited

U.S. PATENT DOCUMENTS

| | | | | |
|---|---|---|---|---|
| 6,688,002 | B2 | 2/2004 | Momose | |
| 2002/0108251 | A1 | 8/2002 | Brum | |
| 2008/0168657 | A1 | 7/2008 | Cloke | |
| 2009/0000126 | A1 | 1/2009 | Kraus | |
| 2017/0008179 | A1* | 1/2017 | Shimizu | B26B 19/36 |

FOREIGN PATENT DOCUMENTS

| | | |
|---|---|---|
| JP | 5688559 | 3/2015 |
| WO | 98/28112 | 7/1998 |
| WO | 2015/025064 | 2/2015 |

OTHER PUBLICATIONS

International Preliminary Report On Patentability dated Sep. 28, 2020 For International Application No. PCT/EP2020/060302 Filed Apr. 10, 2020.

* cited by examiner

PRESSURE SENSING ELECTRIC SHAVER

CROSS REFERENCE TO RELATED APPLICATIONS

This application is a continuation of U.S. patent application Ser. No. 17/284,897 filed Apr. 13, 2021, which is the U.S. National Phase application under 35 U.S.C. § 371 of International Patent Application No. PCT/EP2020/060302 filed Apr. 10, 2020, which claims the benefit of European Patent Application Number 19170323.0 filed Apr. 18, 2019. These applications are hereby incorporated by reference herein.

FIELD OF THE INVENTION

The invention relates to a shaver according to the introductory portion of claim 1. Such a shaver is known from WO2015/025064.

BACKGROUND OF THE INVENTION

During shaving, a user generally tries to achieve a clean shave in a short time while avoiding skin irritation and skin injury. Skin irritation and injury occur when the hair-cutting member comes into contact with the skin too intensively, which occurs particularly when the user presses the hair-cutting member against the skin with excessive force. This can occur during use of manual wet-shavers as well as during use of electric shavers (razors). In particular users who have recently switched from one system to the other or inexperienced users tend to have difficulties in pressing the shaving head against the skin with a pressure in a range of suitable pressures while following the shape of the body part to be shaved. The range of suitable pressures may also vary with skin thickness.

U.S. Pat. No. 5,983,502A discloses a shaver in which pressure against the skin is measured by measuring the extent to which hair-cutting units (sometimes referred to as shaving heads) are pressed into the hair-cutting body. If a sensor signals a too large inward displacement of the hair-cutting units, a signal warning the user that a too high shaving pressure is exerted is generated. The sensor of each hair-cutting unit comprises annular permanent magnets, which are secured to a coupling pin, and a Hall-sensor, which is disposed underneath the magnet and which is secured in the main body.

However, inward displacement of the cutting units is limited and to a large extent used for accommodating the orientations of the cutting units to the curvature of the skin surface being shaved by tilting of cutting units relative to the hair-cutting body. Thus, indication of exerted pressure is also affected by tilting of the hair-cutting units while accommodating to the curvature of the skin being shaved and the range of displacement available for pressure force measurement is reduced by the range of displacement required for allowing tilting.

In the shaver according to WO2015/025064, this problem has been solved by measuring shaving pressure in accordance with displacement and tilting of the hair-cutting body (which includes the cutting units) relative to the main body. This allows the cutting units to tilt and be pressed-in while accommodating to the shape of the skin without interfering with shaving pressure measurement. However, a shaver with shaving pressure signalization according to WO2015/025064 is relatively complicated and manufacturing is costly. Also, the suspension is relatively large in radial directions.

SUMMARY OF THE INVENTION

It is an object of the present invention to provide a shaver that provides accurate indications of shaving pressure but is of a more simple and compact construction.

According to the invention, this object is achieved by providing a shaver according to the claims.

Because, in addition to a resilient member, an anti-tilting guide is provided for guiding at least the sensor unit carrier with respect to the main body against tilting about at least the y-axis perpendicular to the x-axis and the z-axis, tilting that strongly influences the distance between the first sensor unit and the second sensor unit in z-direction is at least substantially reduced. Thus, displacement of the shaving unit, and accordingly the exerted force that causes the applied shaving pressure, can be measured, with no or very little influence by tilting of the shaving unit, by one simple sensor that only needs to be arranged and configured for measuring a distance between the first and second sensor units in the direction of the z-axis and can be conveniently located at some distance in x-direction away from the z-axis, where space is available for accommodating the sensor units, even in a compact shaver.

The anti-tilting guide may allow tilting of the sensor unit carrier about the x-axis perpendicular to the y-axis and to the z-axis and may allow pivoting of the sensor unit carrier about the z-axis. The guiding against tilting generally may allow some play and/or elasticity, so that tilting about the y-axis is substantially reduced by the anti-tilting guide but is not necessarily completely eliminated.

Particular elaborations and embodiments of the invention are set forth in the dependent claims.

Further features, effects and details of the invention appear from the detailed description and the drawings.

DETAILED DESCRIPTION OF THE EMBODIMENTS

Figure 1:
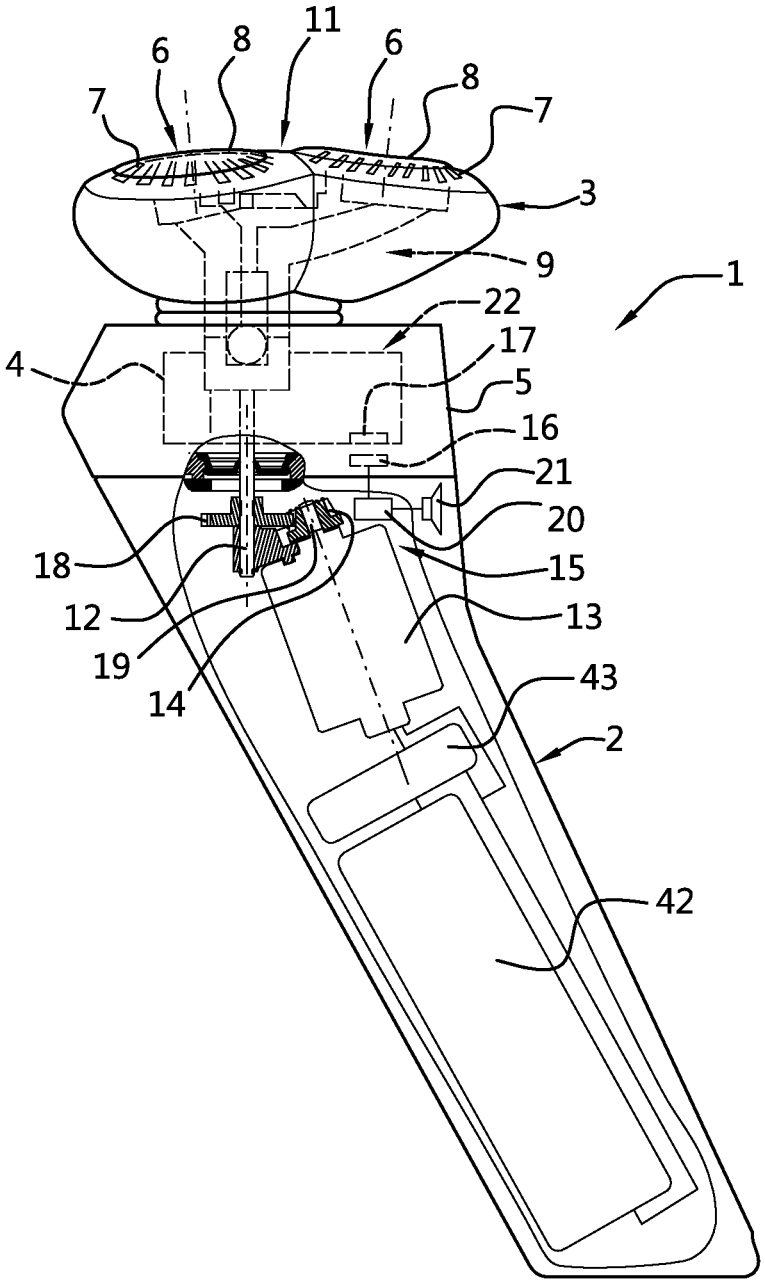
FIG. 1 is a partially cut-away side view of an example of a shaver according to the invention.
Figure 2:
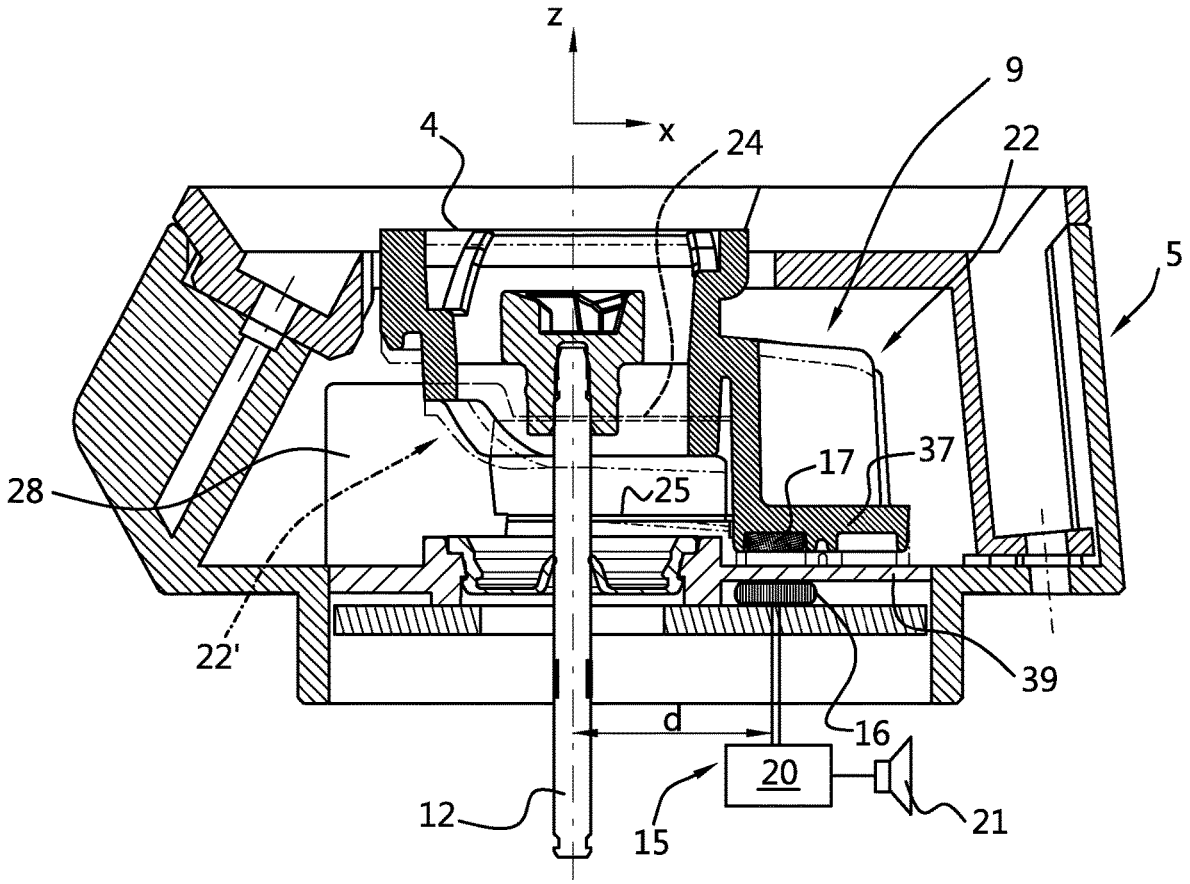
FIG. 2 is a cross-sectional view of a top part of a main body of the shaver shown in FIG. 1.
Figure 3:
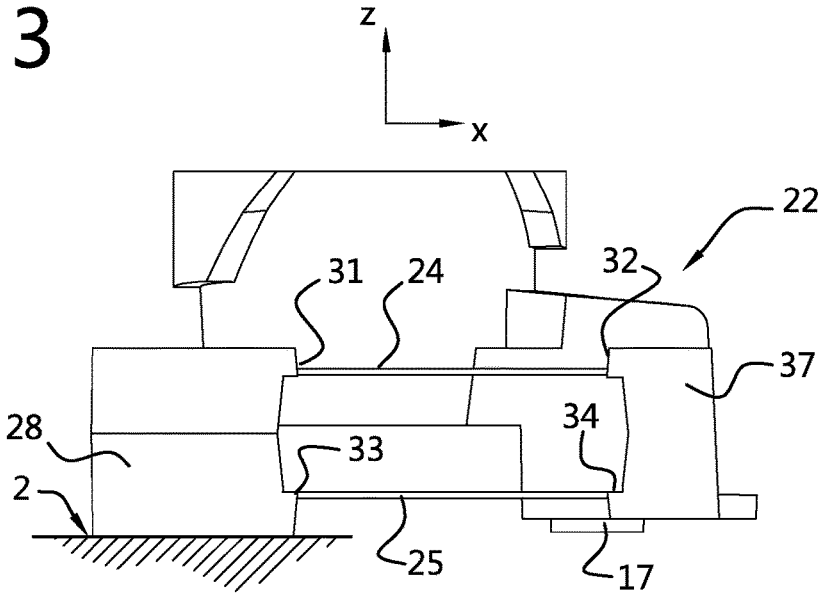
FIG. 3 is a side view of a sensor unit carrier and of guides for guiding at least the sensor unit carrier with respect to the main body of the shaver shown in FIGS. 1 and 2.
Figure 4:
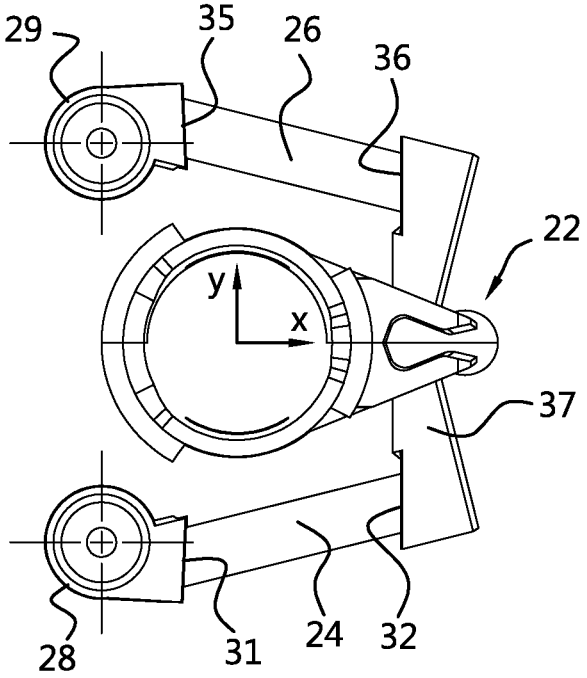
FIG. 4 is a top plan view of the sensor unit carrier and the guides shown in FIG. 3.
Figure 5:
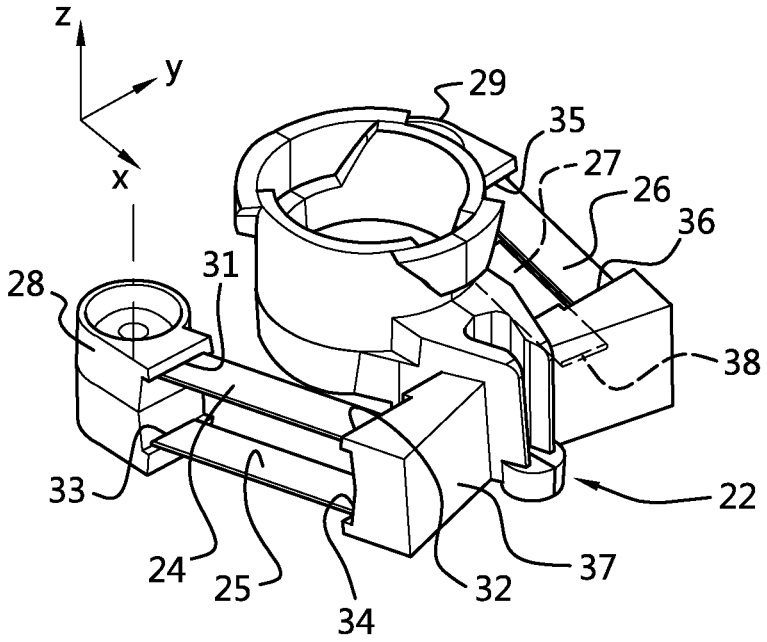
FIG. 5 is a perspective view of the sensor unit carrier and the guides shown in FIGS. 3 and 4.

FIG. 1 shows an example of a shaver 1 according to the invention. The shaver 1 shown in FIG. 1 has a main body 2, which is suitable to be held by a user of the shaver. In FIG. 1, for the sake of simplicity, the main body 2 and components therein are shown schematically. The shaver 1 further has a shaving unit 3, which is suitable to contact an area of skin having hairs to be shaved off and which can suitably be moved over this area, so as to slide over the skin. In this example, the shaving unit 3 is connected to the main body 2 through a central coupling member 4 shown in FIG. 2 which shows a top end part 5 of the main body 2. In FIG. 2, the shaving unit 3 is detached from the main body 2 and therefore not shown. Cross-sectional dimensions of the central coupling member 4 are considerably smaller than the cross-sectional dimensions of the shaving unit 3, and the shaving unit 3 is positioned at a distance from the top end part 5 of the main body 2. Consequently, the connection between the main body 2 and the shaving unit 3 has a slim appearance and the shaving unit 3 has an elevated position with respect to the main body 2, so that, in use, the shaving unit 3 is minimally obscured from view by the main body 2.

The shaving unit 3 has three cutting units 6 (of which only two are visible in FIG. 1), which are arranged in a triangle formation and exposed on a shaving face 11 of the shaver 1. The number of cutting units may also be two or more than three. The cutting units 6 may be arranged so as to be movable to a certain extent so that the cutting units 6 can be urged into a configuration accommodating to a curved or flat contour of an area of skin to be shaved. For example, the cutting units 6 may be individually depressible and thereby tiltable, to a limited extent relative to a cutting unit carrier 9 via which the cutting units 6 are supported relative to the main body 2. Each cutting unit 6 has a cap-shaped external cutting element (guard) 8 forming an outside surface of the cutting unit 6, and which has a plurality of openings for letting through hairs to be shaved off. The external cutting elements 8 are each depressible and thereby tiltable relative to the cutting unit carrier 9. Directly inside of each cap-shaped external cutting element 8, an internal cutting element 7 is rotatably arranged. During operation, cutting edges of the internal cutting elements 7 are pressed against the cap-shaped external cutting element 8 under spring force and each slide along an interior surface of the associated one of the external cutting elements 8. As in the present example, the shaving face 11 is not necessarily flat and the cutting units 6 can be facing in slightly different converging or diverging directions when in rest positions and when tilted during shaving to accommodate to the shape of the skin surface being shaved.

In the present example, the cutting unit carrier 9 is further connected to the main body 2 via a main drive shaft 12 for commonly driving the internal cutting elements 7 of the cutting units 6 via gear wheels (not shown). The main drive shaft 12 is coupled to a motor 13 in the main body 2. A gear wheel 18 on the main drive shaft 12 is engaged by a driving gear wheel 14 on an output drive shaft 19 of the motor 13. The central coupling member 4 engages a coupling member of a central gear wheel (not shown) engaging the gear wheels. While in the present example, the cutting units have internal cutting elements that are in rotating movement when the shaver is in use, the present invention is also applicable to shavers with cutting elements having internal cutting elements that move back and forth linearly between first and second end positions in an oscillating fashion.

For power supply to the motor 13, a battery 42 is provided and is connected to a motor controller 43 that controls power supply to the motor 13 to which the motor controller 43 is connected. The motor controller 43 may be provided with a switch for receiving control input from a user.

The shaving unit 3 is suspended to the main body 2 for displacement from a rest position (as shown) towards the main body 2 along a z-axis oriented transverse to the shaving face 11 to a pushed-in position slightly closer to the main body 2 than the position shown in FIG. 1, in response to a pushing force exerted onto the shaving face 11 of the shaver 1. The shaving unit 3 is connected to a sensor unit carrier 22 to which the second sensor unit 17 is mounted so that the shaving unit 3 and the sensor unit carrier 22 move in z-directions in unison. In this example, the central coupling member 4 is part of the sensor unit carrier 22 and is arranged for coupling to the cutting unit carrier 9 of the shaving unit 3.

The shaving unit may be entirely or partially tiltable relative to the sensor unit carrier to allow easy accommodation of the orientation of the shaving face to the orientation of the skin surface to be shaved. Instead, the shaving unit may be fixed relative to the sensor unit carrier and, instead of being detachable, as in the present example, the shaving unit may be permanently fixed to the sensor unit carrier or integrally formed with the sensor unit carrier. Furthermore, while in this example, the sensor unit carrier 22 is a part of the main body 2, it may instead be a part of the shaving unit.

The sensor 15 has a first sensor unit 16 mounted in a fixed position relative to the main body 2 and a second sensor unit 17 mounted in a fixed position to the sensor unit carrier 22. The first sensor unit 16 and the second sensor unit 17 are offset from the z-axis over a distance d in an x-direction perpendicular to the z-direction. The sensor 15 further has a signal processing unit 20 connected to the first sensor unit 16 and a sound generator 21 connected to an output port of the signal processing unit 20. The sensor 15 is arranged and configured for outputting a signal indicating a distance of the second sensor unit 17 to the first sensor unit 16. In the present example, the first sensor unit 16 is a hall sensor and the second sensor unit 17 is a magnet. Other types of distance sensor units, such as optical sensors or inductive sensors as described in WO2015/025064, are conceivable as well. Instead of or in addition to a sound generator, other signal output means can be used. The generated warning signal can be humanly perceptible or be of a type that is to be received by a receiver of a signal processing device that generates the humanly perceptible warning signal in response to receiving a warning output signal from a signal output transmitter of the shaver, preferably in real time or almost in real time.

As can be seen in FIGS. 2-5, suspension arms 24, 25, 26, 27, acting as resilient members, interconnect posts 28, 29 fixed to the main body 2 with the sensor unit carrier 22. These suspension arms 24, 25, 26, 27 are shaped and dimensioned for exerting a force along the z-axis biasing the shaving unit 3 with the cutting unit carrier 9 as well as the sensor unit carrier 22 in a direction from the pushed-in position 22' (shown by dashed lines in FIG. 2) towards the rest position of the sensor unit carrier 22 (as shown by solid lines in FIG. 2).

The suspension arms 24, 25, 26, 27 are shaped and dimensioned such that the sensor unit carrier 22 moves out of the rest position to the pushed-in position 22' (see FIG. 2) only in response to a force in z-direction exerted onto the shaving face 11 that corresponds to a pressure exerted onto the skin during shaving that is larger than is advisable to avoid irritation of the skin due to too much bulging of the skin into the openings in the external cutting elements 8 of the hair-cutting units 6. Such a movement into the pushed-in position 22' results in a significant reduction of the distance in z-direction between the first sensor unit 16 and the second sensor unit 17 and accordingly in a change of the distance signal received outputted from the first sensor unit 16 to the signal processing unit 20. The signal processing unit is arranged for generating and outputting a sound signal to the sound generator 21 if the received distance signal is below a preset value slightly higher than a value associated to a distance in z-direction between the first sensor unit 16 and the second sensor unit 17 if the sensor unit carrier 22 is in the pushed-in position 22'. The sound generator 21 is arranged for generating an easily audible warning signal in response to a sound signal received from the signal processing unit 20. Accordingly, exerting a force in z-direction of such a magnitude, that a shaving pressure is exerted, via the shaving face 11, which exceeds the advisable maximum shaving pressure, causes the sensor unit carrier 22 to be pushed into the pushed-in position 22' and causes a warning signal to be generated by the sound generator 21. This warns the user that too much force and thus too much shaving pressure has been exerted. After some time, the user will learn what force can be exerted without causing an excessive shaving pressure alarm.

Conversely, the measured displacement and accordingly the force exerted in z-direction can also be used to detect exertion of a force that is too small to generate a shaving pressure that is high enough to achieve a clean shave. In response to a too low shaving pressure, a second warning signal can be generated to warn the user that more pressure should be exerted if a clean shave is to be achieved.

In the present example, the second (or first) one of each pair of suspension arms 24, 25 and 26, 27 constitutes an anti-tilting guide for guiding the sensor unit carrier 22 with respect to the main body 2 against tilting about an y-axis perpendicular to the x-axis and the z-axis during movement with the shaving unit 3 between the rest position and the pushed-in position 22' along the z-axis. Each pair of suspension arms 24, 25 and 26, 27 provides guidance with a high degree of stiffness against tilting about axes in y-direction.

Since tilting of the sensor unit carrier 22 about the y-axis is substantially reduced, disturbance of the distance between the first sensor unit 16 and the second sensor unit 17 by tilting is substantially reduced. Because the first sensor unit 16 and the second sensor unit 17 are offset over a distance d in an x-direction from the z-axis, tilting of the sensor unit carrier 22 about the y-axis would cause the second sensor unit 17 to move in mainly the z-direction, so that virtually the full movement of the second sensor unit 17 due to such tilting would be in the z-direction and thus in the direction in which the distance between the first sensor unit 16 and the second sensor unit 17 is measured. By substantially reducing tilting about the y-axis, such a large influence of the tilting on the distance between the first sensor unit 16 and the second sensor unit 17 is avoided.

If for instance the stiffness of the resilient members in z-direction is such that the ratio between the force exerted in z-direction from the rest position towards the pushed-in position and displacement in that direction is between 10 and 16 N/mm and/or such that the force needed for fully pressing the cutting unit carrier 9 towards the pressed-in position is between 4 and 10 N, the overall stiffness against tilting about the y-axis achieved in the presence of the anti-tilting guide is preferably such that a ratio between a friction force exerted onto the shaving face 11 and displacement of the second sensor unit 17 in the z-direction due to tilting about the y-axis is more than 15 N/mm and more preferably more than 20 N/mm.

Preferably, the cutting unit carrier 9 carrying the hair-cutting units 6 is tiltable relative to the sensor unit carrier 22 so as to allow tilting of the hair-cutting units 6 and the shaving face 11 relative to the sensor unit carrier 22 without causing displacement of the sensor unit carrier 22 relative to the main body 2 along the z-axis. Thus, tilting of the hair-cutting units 6 to accommodate the orientation of the shaving face 11 to the orientation of the skin being shaved can be achieved without significantly influencing the shaving pressure reading in the form of the signal outputted by the first sensor unit 16 to the signal processing unit 20.

The main drive shaft 12 has an axis of rotation extending along the z-axis centrally between the cutting units 6. Thus, rotation driven by the motor 13 can be evenly distributed to the cutting units 6 in a simple manner. Furthermore, by arranging the main drive shaft 12 centrally along the z-axis of the shaving unit 3, the cutting unit carrier 9 and the sensor unit carrier 22, the main drive shaft 12 is conveniently extends centrally through these parts while the z-axis also extends centrally between the cutting units 6. Thus, a shaving pressure evenly distributed over the cutting units 6 is exerted along the z-axis and therefore does not result in a bending moment being exerted about the z-axis. In practice, the resultant force of the aggregated shaving pressure is exerted along a line that will move around in an area around the central z-axis, so that, with the z-axis centrally between the cutting units 6, also the maximum bending moments that are exerted are kept to a minimum.

In the present example, first suspension arms 24, 26 are attached to the main body 2 at first locations 31, 35 and attached to the sensor unit carrier 22 at second locations 32, 36. The first suspension arms 24, 26 each extend between the first locations 31, 35 and the second locations 32, 36. In this suspension, the anti-tilting guide is provided in a very effective and in principle friction free manner by second suspension arms 25, 27 attached to the main body 2 at third locations 33 (one location not visible in any of the drawings) and attached to the sensor unit carrier 22 at fourth locations 34, 38. Also the second suspension arms 25, 27 extend between the third locations 33 and the fourth locations 34, 38. All the suspension arms are elastically deformable, more in particular bendable, in planes parallel to the z-axis.

The first and third locations 31, 35 and 33 are mutually spaced over a first distance having at least a component in a direction parallel to the z-axis. The second and fourth locations 32, 36 and 34, 38 are mutually spaced over a second distance also having at least a component in a direction parallel to the z-axis. The component in the direction parallel to the z-axis of the first distance is of a length identical to the length of the component in the direction parallel to the z-axis of the second distance. Thus, a suspension of the sensor unit carrier 22 is obtained that is flexible in z-direction, but very stiff against tilting about the y-axis and also stiff enough against tilting about the x-axis and pivoting about the z-axis. Although tilting about the x-axis and pivoting about the z-axis influence the distance between the first sensor unit 16 and the second sensor unit 17 to a far lesser extent than tilting about the y-axis, stiffness against such tilting and pivoting is also advantageous for avoiding disturbance of the measurement of shaving pressure in the z-direction.

In the present example, the suspension includes two of the first suspension arms 24, 26 and two of the second suspension arms 25, 27. Providing at least two of the first suspension arms 24, 26 or at least two of the second suspension arms 25, 27, is advantageous to further counteract tilting and pivoting about the z-axis in particular if relatively slender suspension arms are provided in view of limited space available adjacent to the sensor unit carrier 22.

Furthermore, the two first suspension arms 24, 26 as well as the two second suspension arms 25, 27 are located on opposite sides of a plane defined by the x- and z-axes. Thus, a generally symmetrical arrangement of the suspension arms 24, 26 and 25, 27 is obtained in which the two first suspension arms 24, 26 as well as the two second suspension arms 25, 27 can be arranged far apart yet closely along the cutting unit carrier 9.

For obtaining further guidance against tilting in a compact construction, the two first suspension arms 24, 26 as well as the two second suspension arms 25, 27 are interconnected by a bridge 37 fixedly connected with the interconnected pair of suspension arms 24, 26 and 25, 27. This further increases stiffness of the combined suspension arms against tilting.

The two first suspension arms 24, 26 as well as the two second suspension arms 25, 27 diverge towards or away from a plane defined by the y- and z axes, so that the suspension is also stiff against translational displacements in y-direction transverse to the z-axis.

For achieving a particularly high stiffness against tilting about the y-axis with a compact construction, the first locations 31, 35 and the third locations 33, where the suspension arms 24-27 are attached to the main body 2, are positioned on a common side of a plane defined by y- and z-axes, so that the suspension arms 24, 25 and 26, 27 of each pair and the elements 22, 28 and 29 to which these suspension arms are connected generally form a parallelogram in a plane in z-direction and, generally, x-direction and thus provide a high degree of stiffness against tilting. The distance between the suspension arms 24, 25 and 26, 27 can for instance be 5 to 10 mm.

For particularly accurate guidance in z-direction, it is furthermore advantageous that the first locations 31, 35 and third locations 33, where the suspension arms 24-27 are attached to the main body 2, are positioned in a plane parallel to the plane defined by the y- and z-axes.

In the present example, guidance against tilting is achieved in a particularly simple manner and without play in the suspension, because the first and second suspension arms 24-27 are provided in the form of flat leaf springs each having a length in a direction from the first location 31, 35 to the second location 34, 36 or from the third location 33 to the fourth location 34, 38 where the suspension arms 24-27 are fixedly attached and a width in a direction parallel to the y-axis. These effects can be achieved to a lesser extent (for individual arms only) by only providing one or more of the suspension arms 24-27 in the form of such a leaf spring.

The leaf springs are preferably relatively flexible for allowing movement of the sensor unit carrier 22 in z-direction, while being stiff enough in planes perpendicular to the z-direction to provide sufficiently accurate guidance to limit movement in other directions than the z-direction. To this end, the flat leaf springs preferably each have a stiffness against bending in a plane perpendicular to the z-axis which is at least three times, and, more preferably, at least five or at least seven times a stiffness of the leaf springs against bending in a plane parallel to the z-axis.

The axis of rotation of the main drive shaft 12 passes between the suspension arms 24, 25 and 26, 27 of each of the pairs of suspension arms. Thus a compact construction is achieved, because the elongated suspension arms 24-27 extend on opposite sides along the sensor unit carrier 22. Moreover, the distance in x-direction between the fixed attachments at locations 31, 33, 35 to the (posts 28, 29 of) the main body 2 and the average center of effort of shaving pressure, which is along the axis of rotation of the main drive shaft 12, is much shorter than the lengths of the suspension arms 24-27 that are also oriented mainly in x-direction. Thus, while sufficiently long suspension arms 24-27 can be accommodated for providing an amount of spring travel required for urging the sensor unit carrier 22 from the pushed-in position 22' towards the rest position while exerting a fairly constant force, the distance in x-direction between the fixed attachments at locations 31, 33, 35 to the main body 2 and the average center of effort of shaving pressure can be much shorter than the length of the suspension arms 24-27, so that tilting about the y-axis as a result of bending moments exerted onto the suspension arms 24-27 is further reduced.

In the present example, a particularly simple construction with a relatively small number of parts is moreover achieved, because the suspension arms 24-27 are implemented as leaf springs forming the anti-tilting guides and also constitute a resilient member that urges the sensor unit carrier 22 from the pushed-in position 22' towards the rest position of the sensor unit carrier 22. Also in other embodiments of the invention, it is advantageous for simplicity of construction and reducing the number of parts if a spring member that forms the anti-tilting guide also forms a resilient member that urges the sensor unit carrier 22 from the pushed-in position 22' towards the rest position.

For reliable operation of the shaver 1, in particular if the shaver 1 is also arranged for wet-shaving, it is advantageous if, as in the present example, the first sensor unit 16 is mounted in a position shielded from the environment by a shielding 39, so as to be hermetically and dust free separated from the environment. The second sensor unit 17 is mounted in a position outside that shielding 39. This allows the moving sensor unit carrier 22 to be arranged completely outside the shielding 39 and no moving parts for transferring movement in z-direction to measure such movement have to extend through the shielding 39, so that the need of sealing such moving parts against the shielding is avoided.

Figure 6:
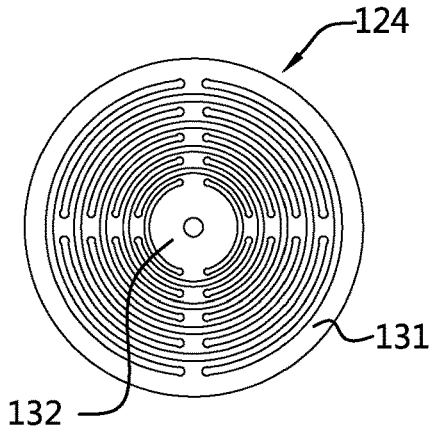
FIG. 6 is a top plan view of a suspension spring for forming an arm of an alternative example of a guide of a shaver according to the invention.

In FIG. 6 an alternative spring member 124, which can be provided instead of the suspension arms of the example shown in FIGS. 1-5, is shown. By providing two of such spring members 124 in a co-axial arrangement with a spacing in z-direction and with outer circumferences 131 fixedly attached relative to the main body and central portions 132 attached to an accordingly designed version of the sensor unit carrier, a suspension is obtained that provides both the resilient member for urging the cutting unit carrier towards its rest position and, in the form of the two spring members 124, the guide against tilting about the y-axis.

Figure 7:
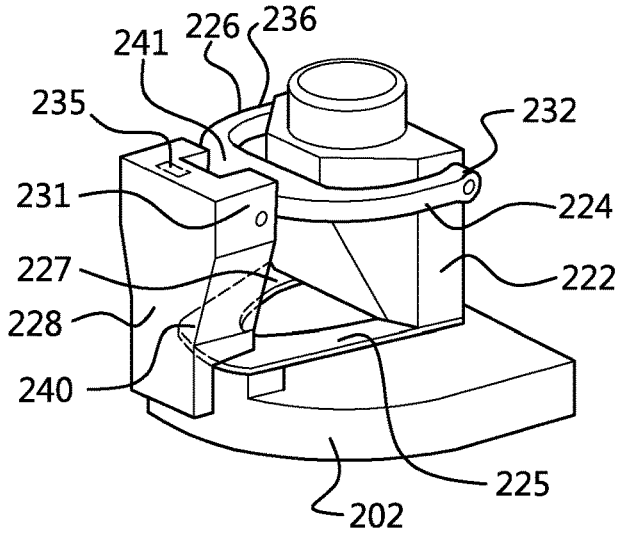
FIG. 7 is a perspective view of another example of a sensor unit carrier and of guides of a shaver according to the invention.

In FIG. 7 a suspension of the sensor unit carrier 222 of a further example of a shaver according to the invention is shown. In this example, upper suspension arms 224, 226 of the suspension arms 224, 225 and 226, 227 are provided in the form essentially rigid arms that are hinged at attachments positions 231, 232, 235, 236 at ends of the upper suspension arms 224, 226. In the present example, the upper suspension arms 224, 226 form the anti-tilting guide. As in the example shown in FIGS. 1-5, the lower suspension arms 225, 227 are provided in the form of leaf springs and also form the resilient member. However, in this example, the lower suspension arms 225, 227 are integrally formed with a bridge portion 240 between the lower suspension arms 225, 227 at the side of the lower suspension arms 225, 227 fixed to a post 228 of the main body 202. Also the upper (hinged) suspension arms 224, 226 are integrally formed with a bridge portion 241. This bridge portion 241 is also located at the side of the upper suspension arms 224, 226 that is coupled (here hinged) to the post 228 of the main body 202. Bridge portions integrally formed with the suspension arms may also or alternatively be provided at the sides of the suspension arms coupled to the sensor unit carrier 222. Particular advantages of a bridge portion integrally formed with suspension arms are that a particularly rigid connection between the suspension arms is obtained and that the two upper or lower suspension arms constitute a single part, which facilitates assembly and handling of parts.

Figure 8:
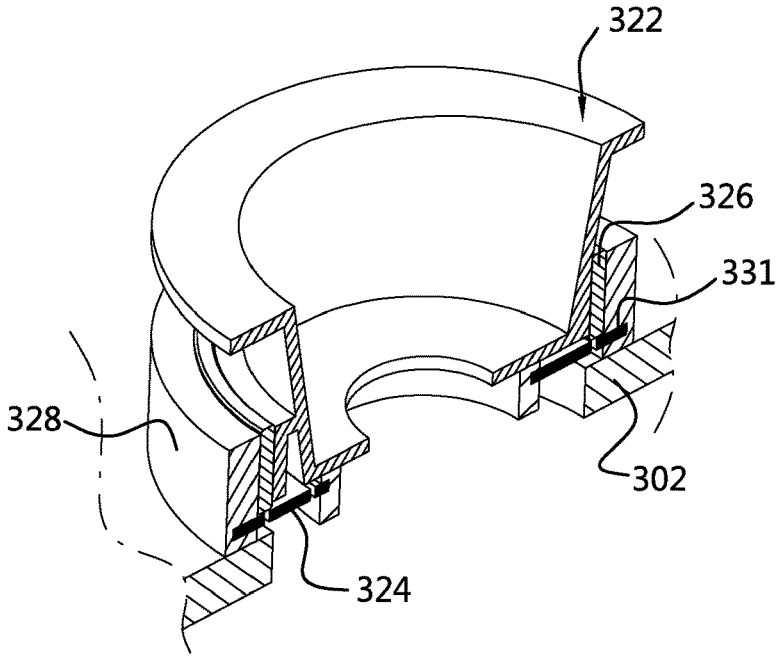
FIG. 8 is a cross-sectional perspective view of yet another example of a sensor unit carrier and of guides of a shaver according to the invention.

In FIG. 8 yet another example of a suspension for suspending a sensor unit carrier 322 relative to a main body 302 in a shaver according to the invention is shown. In this example, the resilient member is formed by a spring member 324 similar to the spring member 124 shown in FIG. 6. At its outer circumference 331, the spring member 324 is fixed to an annular projection 329 of a main body 302. The anti-tilting guide is provided in the form of a ring 326 that has a cylindrical inner wall surface in close sliding contact with a cylindrical outer wall surface of the sensor unit carrier 322. An outer cylindrical wall surface of the ring 326 is in close sliding contact with an inner cylindrical wall surface of the annular projection 329 of a main body 302. Thus, the sensor unit carrier 322 is telescopically guided relative to the main body 302, so that tilting of the sensor unit carrier 322 is counteracted.

Although in the shown examples, the resilient member is a spring, other forms of resilient members are conceivable as well, such as a pair of mutually repelling magnets or a pneumatic cylinder.

While the invention has been described and illustrated in detail in the foregoing description and in the drawing figures, such description and illustration are to be considered exemplary and/or illustrative and not restrictive; the invention is not limited to the disclosed embodiments.

Several features have been described as part of the same or separate embodiments. However, it will be appreciated that the scope of the invention also includes embodiments having combinations of all or some of these features other than the specific combinations of features embodied in the examples.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. For the purpose of clarity and a concise description, features are disclosed herein as part of the same or separate embodiments; however, it will be appreciated that the scope of the invention may include embodiments having combinations of all or some of the features disclosed. The mere fact that certain measures are recited in mutually different dependent claims does not indicate that a combination of these measures cannot be used to advantage. Any reference signs in the claims should not be construed as limiting the scope.

The invention claimed is:

1. An electric shaver comprising:

a main body;

a shaving unit having at least two cutting units exposed on a shaving face of the shaver, each cutting unit being mounted to a cutting unit carrier of the shaving unit and comprising an external cutting guard and an internal cutting member, a sensor comprising a first sensor unit mounted in a fixed position relative to the main body and a second sensor unit mounted in a fixed position relative to a sensor unit carrier, wherein the sensor is configured for outputting a signal indicating a distance of the second sensor unit to the first sensor unit in a direction parallel to a z-axis which is oriented transverse to the shaving face; and at least one suspension arm arranged between the main body and the shaving unit, wherein the at least one suspension arm is flexible for allowing movement of the sensor unit carrier the direction parallel to the z-axis, wherein the at least one suspension arm suspends the shaving unit and the sensor unit carrier with respect to the main body for displacement in unison from a rest position towards the main body along the z-axis to a pushed-in position in response to a pushing force exerted onto the shaving face of the shaver, wherein the at least one suspension arm is configured for exerting a resilient force along the z-axis biasing the shaving unit in a direction from the pushed-in position towards the rest position, and wherein the first sensor unit and the second sensor unit are located in positions offset from the z-axis over a distance in a direction parallel to an x-axis which extends perpendicularly to the z-axis, and wherein the at least one suspension arm is configured to provide greater stiffness against tilting of the sensor unit carrier with respect to the main body about a y-axis, which extends perpendicularly to the x-axis and the z-axis, than stiffness against tilting about the x-axis and the z-axis during movement of the shaving unit between the rest position and the pushed-in position along the z-axis.

2. The shaver according to claim 1, wherein the cutting unit carrier carrying the cutting units is tiltable relative to the sensor unit carrier so as to allow tilting of the at least two cutting units relative to the sensor unit carrier without causing displacement of at least the sensor unit carrier relative to the main body along the z-axis.

3. The shaver according to claim 1, further comprising a central coupling member mounted to the sensor unit carrier and configured for releasably coupling the cutting unit carrier to the sensor unit carrier.

4. The shaver according to claim 1, wherein the cutting unit carrier is further connected to the main body via a main drive shaft for commonly driving the internal cutting members of the cutting units.

5. The shaver according to claim 4, wherein the main drive shaft has an axis of rotation extending along the z-axis centrally between the cutting units.

6. The shaver according to claim 1, wherein the first sensor unit is mounted in a position shielded from an environment by a shielding and wherein the second sensor unit is mounted in a position outside the shielding.

7. The shaver according to claim 1, wherein the stiffness against tilting about the y-axis is such that a ratio between a friction force exerted onto the shaving face and displacement of the second sensor unit in the direction parallel to the z-axis due to the tilting about the y-axis is more than about 15 N/mm.

8. An electric shaver, comprising:

a main body, a shaving unit having at least two cutting units exposed on a shaving face of the shaver, each cutting unit being mounted to a cutting unit carrier of the shaving unit and comprising an external cutting guard and an internal cutting member;

a sensor comprising a first sensor unit mounted in a fixed position relative to the main body and a second sensor unit mounted in a fixed position relative to a sensor unit carrier, wherein the sensor is configured for outputting a signal indicating a distance of the second sensor unit to the first sensor unit in a direction parallel to a z-axis which is oriented transverse to the shaving face;

a first suspension arm attached to a first post on the main body at a first location and attached to the sensor unit carrier at a second location, the first suspension arm extending between the first location and the second location; and a second suspension arm attached to the first post at a third location and attached to the sensor unit carrier at a fourth location, the second suspension arm extending between the third location and the fourth location;

wherein the first and second suspension arms suspend the shaving unit and the sensor unit carrier with respect to the main body for displacement in unison from a rest position towards the main body along the z-axis to a pushed-in position in response to a pushing force exerted onto the shaving face of the shaver, wherein the first and second suspension arms are elastically deformable in directions parallel to the z-axis, and are configured for exerting a resilient force along the z-axis biasing the shaving unit in a direction from the pushed-in position towards the rest position, wherein the first and third locations are mutually spaced over a first distance having at least a component in a direction parallel to the z-axis, the second and fourth locations are mutually spaced over a second distance having at least a component in a direction parallel to the z-axis, wherein the component in the direction parallel to the z-axis of the first distance has a length identical to a length of the component in the direction parallel to the z-axis of the second distance, wherein the first sensor unit and the second sensor unit are located in positions offset from the z-axis over a distance in a direction parallel to an x-axis which extends perpendicularly to the x-axis, and wherein the first and second suspension arms are configured to provide greater stiffness against tilting of the sensor unit carrier with respect to the main body about a y-axis, which extends perpendicularly to the x-axis and the z-axis, than stiffness against tilting about the x-axis and the z-axis during movement of the shaving unit between the rest position and the pushed-in position along the z-axis.

9. The shaver according to claim 8, comprising:

a third suspension arm attached to a second post on the main body at another first location and attached to the sensor unit carrier at another second location, the third suspension arm extending between the another first location and the another second location; and a fourth suspension arm attached to the second post at another third location and attached to the sensor unit carrier at another fourth location, the fourth suspension arm extending between the another third location and the another fourth location;

wherein the third and fourth suspension arms are elastically deformable in directions parallel to the z-axis.

10. The shaver according to claim 9, wherein the first and second suspension arms are located on opposite sides of a plane defined by the x- and z-axes from the third and fourth suspension arms.

11. The shaver according to claim 9, wherein the first and second suspension arms are interconnected with the third and fourth suspension arms by a bridge.

12. The shaver according to claim 9, wherein the first and second suspension arms diverge towards the third and fourth extension arms in a plane extending parallel to the x- and y-axes.

13. The shaver according to claim 8, wherein the first and third locations are positioned on a common side of a plane defined by the y- and z-axes.

14. The shaver according to claim 8, wherein the first and third locations are positioned in a plane parallel to a plane defined by the y- and z-axes.

15. The shaver according to claim 8, wherein at least one of the first and second suspension arms is a flat leaf spring having length in a direction, respectively, from the first to the second location or from the third to the fourth location and a width in a direction parallel to the y-axis.

16. The shaver according to claim 15, wherein the flat leaf spring has a stiffness against bending in a plane perpendicular to the z-axis which is at least three times a stiffness of the leaf spring against bending in a plane parallel to the z-axis.

17. The shaver according to claim 9, wherein a main drive shaft for commonly driving the internal cutting members has an axis of rotation that extends along the z-axis between the first and third suspension arms and/or between the second and fourth suspension arms.

18. The shaver according to claim 8, wherein the cutting unit carrier is further connected to the main body via a main drive shaft for commonly driving the internal cutting members of the cutting units, and wherein the main drive shaft has an axis of rotation extending along the z-axis centrally between the cutting units.

19. An electric shaver comprising:

a main body, a shaving unit having at least one cutting unit exposed on a shaving face of the shaver, the at least one cutting unit being mounted to a cutting unit carrier of the shaving unit and comprising an external cutting guard and an internal cutting member;

a sensor comprising a first sensor unit mounted in a fixed position relative to the main body and a second sensor unit mounted in a fixed position relative to a sensor unit carrier, wherein the sensor is configured for outputting a signal indicating a distance of the second sensor unit to the first sensor unit in a direction parallel to a z-axis which is oriented transverse to the shaving face, and wherein the first sensor unit and the second sensor unit are offset from the z-axis over a distance in a direction parallel to an x-axis which extends perpendicularly to the z-axis, and a first pair of suspension arms connected between a first post arranged on the main body and a bridge of the shaving unit, wherein the first pair of suspension arms are spaced apart by a distance in at least the z-axis;

a second pair of suspension arms connected between a second post arranged on the main body and the bridge of the shaving unit, wherein the second pair of suspension arms are spaced apart by the distance in at least the z-axis, wherein the first and second pairs of suspension arms are flexible for allowing movement of the sensor unit carrier in a direction along the z-axis, thereby dynamically adjusting the distance of the second sensor unit to the first sensor unit, wherein the first and second pairs of suspension arms are configured to exert a resilient force along the z-axis biasing the shaving unit in a direction from a pushed-in position in response to a pushing force exerted onto the shaving face of the shaver, and wherein the first and second pairs of suspension arms are further configured to provide greater stiffness against tilting of the sensor unit carrier with respect to the main body about a y-axis, which extends perpendicularly to the x-axis and the z-axis, than about the x-axis and the z-axis during movement of the shaving unit between a rest position and the pushed-in position along the z-axis.

20. The shaver according to claim 19, wherein the stiffness against tilting about the y-axis is such that a ratio between a friction force exerted onto the shaving face and displacement of the second sensor unit in the direction parallel to the z-axis due to the tilting about the y-axis is more than about 15 N/mm.

* * * * *